US006761537B1

(12) United States Patent
Shapiro et al.

(10) Patent No.: US 6,761,537 B1
(45) Date of Patent: Jul. 13, 2004

(54) METHODS AND APPARATUS FOR ASSEMBLING TURBINE ENGINES

(75) Inventors: David Elliott Shapiro, Niskayuna, NY (US); Ian Darnell Reeves, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/325,426

(22) Filed: Dec. 19, 2002

(51) Int. Cl.[7] ..... F01D 5/30
(52) U.S. Cl. ..... 416/220 R; 416/248; 416/218
(58) Field of Search ..... 416/220 R, 221, 416/215, 216, 218, 248

(56) References Cited

U.S. PATENT DOCUMENTS

| | | | | |
|---|---|---|---|---|
| 2,220,918 A | * | 11/1940 | Smith | 416/191 |
| 2,445,154 A | * | 7/1948 | Reed | 416/221 |
| 2,800,298 A | * | 7/1957 | Schellens | 416/216 |
| 2,805,838 A | * | 9/1957 | Pickup | 416/95 |
| 4,676,723 A | | 6/1987 | Kiger et al. | |
| 4,702,673 A | | 10/1987 | Hansen et al. | |
| 4,711,007 A | | 12/1987 | Conrad | |
| 4,767,247 A | | 8/1988 | Partington et al. | |
| 4,767,273 A | | 8/1988 | Partington | |
| 4,767,275 A | | 8/1988 | Brown | |
| 4,915,587 A | | 4/1990 | Pisz et al. | |
| 5,720,596 A | | 2/1998 | Pepperman | |
| 6,030,178 A | | 2/2000 | Caruso | |
| 6,168,377 B1 | | 1/2001 | Wolfe et al. | |
| 6,287,079 B1 | | 9/2001 | Gosling et al. | |
| 6,416,286 B1 | | 7/2002 | Roberts et al. | |
| 6,438,837 B1 | | 8/2002 | Berry et al. | |
| 6,439,844 B1 | | 8/2002 | Turnquist et al. | |

* cited by examiner

*Primary Examiner*—Ninh H. Nguyen
(74) *Attorney, Agent, or Firm*—Armstrong Teasdale LLP

(57) ABSTRACT

A method of assembling a turbine comprises coupling at least one bucket to a rotor wheel. The bucket includes an upstream side, a downstream side, an airfoil extending therebetween and a dovetail extending radially inwardly from the airfoil to the rotor wheel. The method further comprises fixedly securing the bucket to the rotor wheel with a locking pin that extends from the bucket upstream side through the bucket dovetail to the bucket downstream side.

19 Claims, 4 Drawing Sheets

METHODS AND APPARATUS FOR ASSEMBLING TURBINE ENGINES

BACKGROUND OF THE INVENTION

The present invention relates generally to turbine engines and more particularly to methods and apparatus for securing airfoils used within turbine engines.

At least some known turbine rotor assemblies include a rotor wheel to which a plurality of rows of airfoils are coupled. The airfoils are arranged in axially-spaced stages extending circumferentially around the rotor. Each stage includes a set of stationary airfoils or nozzles, and a set of cooperating rotating airfoils, known as buckets.

Each bucket includes a dovetail that is used to couple the bucket to a matching dovetail slot defined by the rotor wheel. More specifically, each dovetail includes a recessed portion, known as a hook, that is defined by axial tangs, and that enables each airfoil to be slidably coupled to the machined rotor wheel dovetail.

Each rotor wheel dovetail slot is defined by a pair of parallel lands that are machined as part of the slot. During assembly, several bucket dovetails are inserted onto the dovetail lands through a loading slot defined within the rotor wheel dovetail groove lands. The closure bucket is then into the loading to provide a stabile surface to allow coupling of the bucket dovetail to the dovetail lands against the crushing surfaces. Once several buckets are coupled into the proper location, the locking bucket is removed. The coupled buckets now provide the stabile surface for additional buckets. Adjacent buckets are coupled to the rotor wheel through the loading slot and slid circumferentially into position and secured in place with a mounting pin. All of the buckets, with the exception of the closure bucket, are coupled to the rotor wheel by the machined lands.

In operation, the buckets are urged in the radial direction by the centrifugal force induced during rotation, and are also urged in the tangential direction by the aerodynamic force exerted on them by fluid flow. The dovetail tangs of the bucket cooperate with the rotor wheel lands by contact at the crushing surfaces to facilitate preventing movement of the buckets in the radial and tangential directions. However, because the closure bucket is positioned in the loading slot, the land portion of the wheel dovetail does not inhibit radial movement of the closure bucket and as such, it is necessary to restrain the closure bucket in the radial direction to prevent the closure bucket from being released from the loading slot during operation. Known closure buckets are coupled in position by a pair of grubscrews, which are inserted between the closure bucket and the circumferentially adjacent buckets. Inserting known grubscrews can be a time-consuming and laborious task that may require a relatively large machining station, such as a horizontal boring mill. During insertion of the grubscrews localized stress may be induced to the rotor assembly. Furthermore, if maintenance is required, removing the closure bucket may also be very time-consuming and requires the removal of a material peaned over the pins.

BRIEF DESCRIPTION OF THE INVENTION

In one aspect, a method of assembling a turbine is provided. The method comprises coupling at least one bucket including an upstream side, a downstream side, an airfoil and a dovetail, to a rotor wheel. The method also comprises fixedly securing at least one bucket to the rotor wheel with a locking pin that extends from the bucket upstream side through the bucket dovetail to the downstream side.

In another aspect, a rotor assembly for a turbine is provided. The rotor assembly includes a plurality of buckets secured to a rotor wheel. Each bucket includes an upstream side, a downstream side, an airfoil, and a dovetail. Each airfoil extends from each dovetail. The plurality of buckets include at least a first bucket and at least a second bucket. At least one locking pin secures the at least one first bucket to the rotor wheel and extends from the upstream side of the bucket through the bucket dovetail to the downstream side of the bucket.

In a further aspect, a turbine including at least one rotor assembly is provided. The rotor assembly includes at least one rotor wheel and a plurality of buckets secured to the rotor wheel. Each bucket includes an upstream side, a downstream side, an airfoil and a dovetail. The airfoil extends radially from the dovetail. The plurality of buckets include at least one first bucket and at least one second bucket. At least one locking pin secures the at least one first bucket to the rotor wheel such that the locking pin extends from the bucket upstream side through the bucket dovetail to the bucket downstream side.

DETAILED DESCRIPTION OF THE INVENTION

Figure 1:
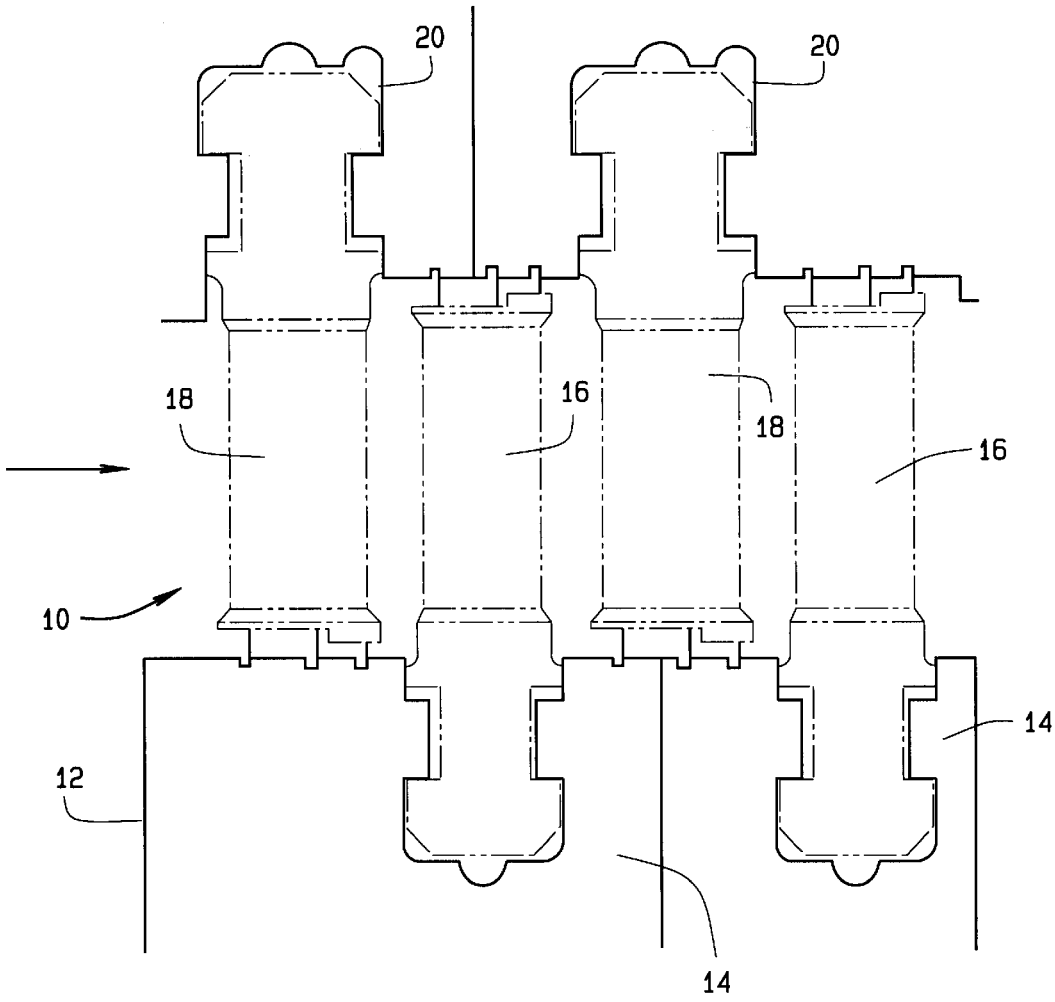
FIG. 1 is a partial cross-sectional schematic view of a reaction steam turbine.

FIG. 1 is a partial cross-sectional schematic illustration of a reaction steam turbine 10 including a drum rotor assembly 12 (hereafter referred to as a rotor) including a plurality of axially spaced wheels 14 used to couple buckets 16 to a rotor assembly 12. A series of nozzles 18 extend in rows between adjacent rows of buckets 16. Nozzles 18 cooperate with buckets 16 to form a stage and to define a portion of a steam flow path indicated by the arrow that extends through turbine 10. Nozzles 18 are coupled to a carrier dovetail 20 that extends between adjacent wheels 14 of the stages of turbine 10.

In operation, high-pressure steam enters an inlet end (not shown) of turbine 10 and moves through turbine 10 parallel to the axis of rotor 12. The steam strikes a row of nozzles 18 and is directed against buckets 16. The steam then passes through the remaining stages, thus forcing buckets 16 and rotor 12 to rotate.

Figure 2:
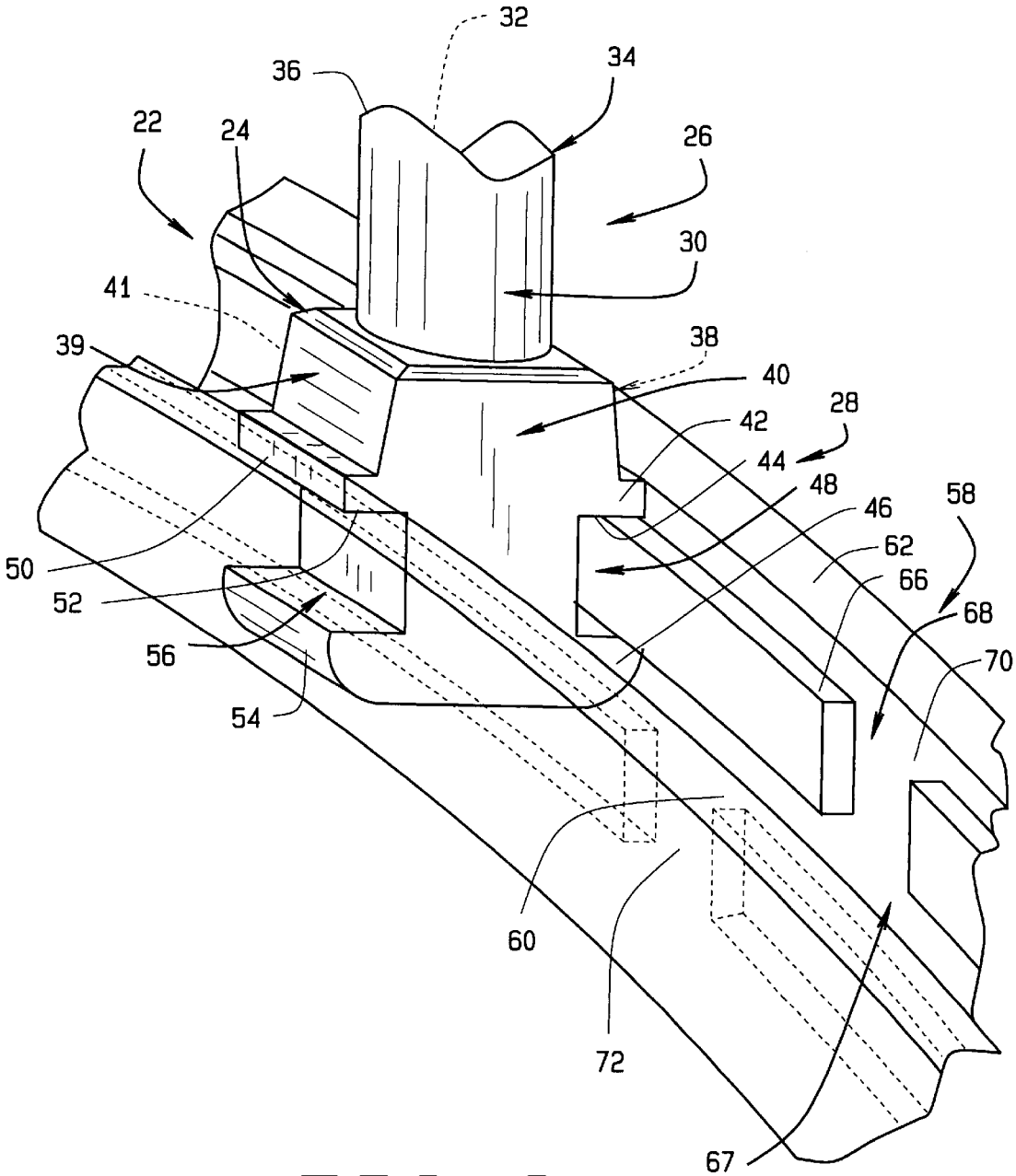
FIG. 2 is a partial perspective view of a bucket coupled within the rotor dovetail shown in FIG. 1.
Figure 3:
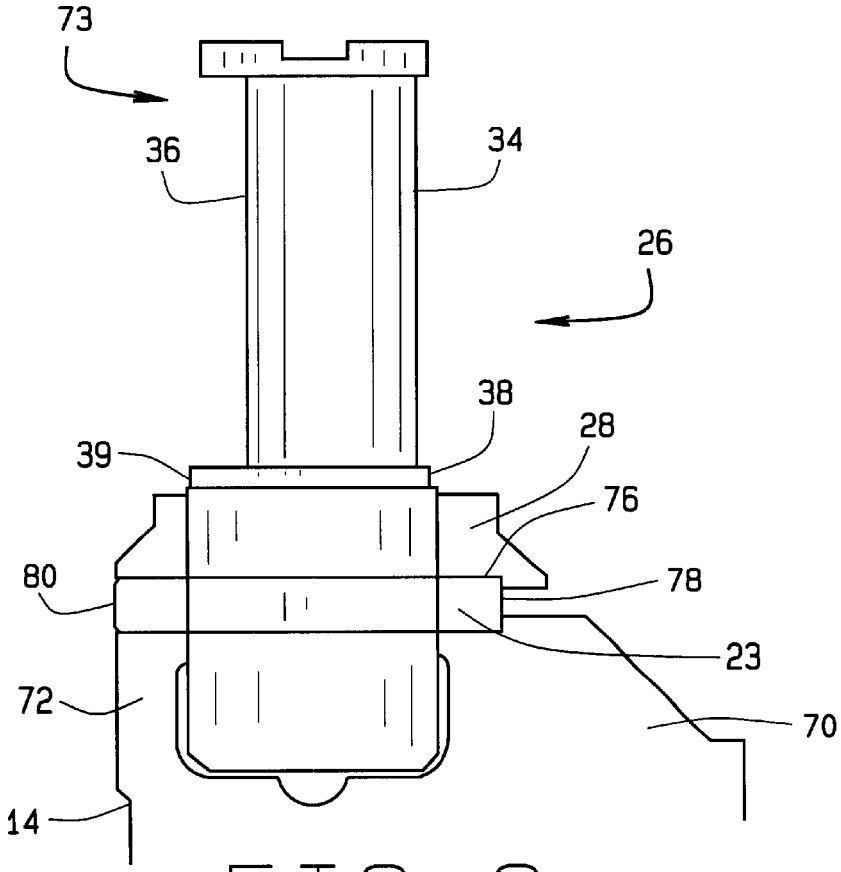
FIG. 3 is a side cross-sectional view of a closure bucket that may be used with the rotor assembly shown in FIG. 1.
Figure 4:
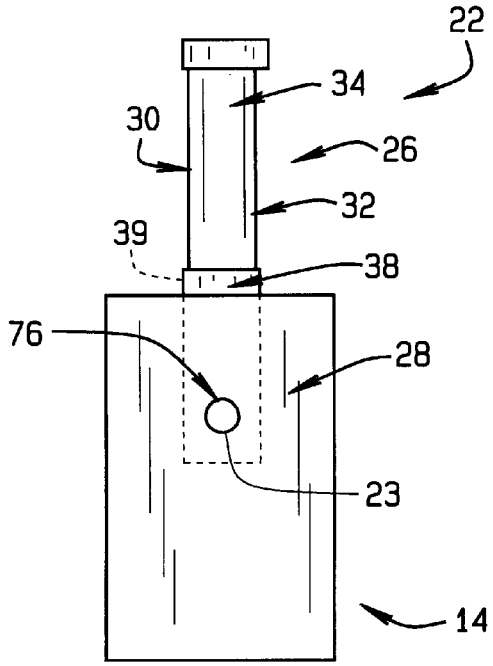
FIG. 4 is a front view of the closure bucket shown in FIG. 3.

FIG. 2 is a perspective view of a bucket 22 coupled to rotor 12 and FIG. 3 is a side cross-sectional view of a closure bucket that may be used with the rotor assembly shown in FIG. 1. FIG. 4 is a front view of a bucket 22 coupled by locking pin 23. Bucket 22 includes a platform 24, an airfoil 26 extending radially outward from platform 24, and a dovetail 28 extending radially inward from the platform 24. Airfoil 26 includes a first contoured sidewall 30 and a second contoured sidewall 32. First sidewall 30 is convex and defines a suction side of airfoil 26. Second sidewall 32 is concave and defines a pressure side of airfoil 26. Sidewalls 30 and 32 are joined at a leading edge 34 and at an axially-spaced trailing edge 36 of airfoil 26.

Platform 24 includes an upstream side 38 and an opposite downstream side 39. In the exemplary embodiment, upstream side 38 and downstream side 39 are substantially parallel. Bucket 22 has a first axial face 40 and an opposite second axial face 41 that each extend between upstream and downstream sides 38 and 39. Upstream side 38 includes a side shoulder 42, known as an outer tang, that extends substantially perpendicularly from upstream side 38 and defines an overhang 44. A dovetail tang 46 also extends substantially perpendicularly from upstream side 38 and is substantially parallel to side shoulder 42, such that an upstream side slot 48 is defined between tang 46 and shoulder 42.

Bucket downstream side 39 includes a side shoulder 50 that extends substantially perpendicularly from downstream side 39. In an exemplary embodiment, shoulder 50 is substantially co-axially aligned with respect to upstream shoulder 42. Side shoulder 50 defines a downstream side overhang 52. A dovetail tang 54 also extends substantially perpendicularly from downstream side 39 and is substantially parallel to side shoulder 50, such that a downstream side slot 56 is defined between. In the exemplary embodiment, tang 54 is substantially co-axially aligned with respect to dovetail tang 46.

Rotor 12 includes at least one annular slot 58 that facilitates coupling each bucket dovetail 28 to rotor 12. Slot 58 is defined by side slot walls 60 and 62 and a radially inward slot wall 64. Machined dovetail lands 66 extend from each side slot walls 60 and 62 to retain each dovetail 28 within dovetail slot 58. Dovetail slot 58 includes loading slot 68 used to enable tangential entry of buckets 22 into dovetail slot 58. Loading slot 68 has side slot walls 70 and 72 that do not include machined dovetail lands 66 such that each bucket dovetail 28 may be slidably coupled into dovetail slot 58 without dovetail tangs 46 or 54 contacting machined dovetail lands 66.

A bucket 73, known as a closure bucket, is inserted into loading slot 68 to facilitate retaining all buckets 22 to rotor 12. Closure bucket 73 is known in the art and includes dovetail 28 that does not include dovetail tangs 46 or 54, but rather includes substantially planar upstream sidewall 77 and a substantially planar downstream sidewall 79 that, as described in more detail below, abut substantially flush against loading slot walls 70 and 72 when closure bucket 73 is inserted into loading slot 68.

More specifically, during assembly of rotor 12, each respective bucket 22 is inserted into loading slot 68, and then circumferentially slid through slot 58 such that machined dovetail lands 66 are disposed in each respective bucket upstream and downstream side slot 48 and 56. Additional buckets 22 are then slidably coupled to rotor wheel 12 in a similar fashion about wheel 12. Closure bucket 73 is then inserted into loading slot 68 to facilitate securing closure buckets 22 to rotor 12. More specifically, when inserted into slot 68, a first face (not shown) of closure bucket 73 contacts a first circumferentially-spaced adjacent bucket 22, and a second face (not shown) of closure bucket 73 contacts an oppositely disposed, second circumferentially-spaced adjacent bucket 22.

Closure bucket 73 is then secured to rotor 12 by inserting a locking pin 23 from bucket upstream side 38 through bucket dovetail 28 to bucket downstream side 39. FIG. 4 is a front view of a bucket coupled by locking pin 23. Locking pin 23 is substantially elongate, and is disposed in a channel 76 having a substantially linear cross-sectional profile. Locking pin 23 secures closure bucket 73 to rotor 12. Channel 76 extends generally from bucket upstream side 38 to bucket downstream side 39.

In the exemplary embodiment, channel 76 extends from a first opening 78 defined in side slot wall 70 through bucket upstream side 38, and through bucket dovetail 28, to bucket downstream side 39, and an opening 80 defined in downstream side slot wall 72.

In an alternative embodiment, channel 76 extends from first opening 78 through bucket upstream side 38, through bucket dovetail 28, to bucket downstream side 39. More specifically, locking pin 23 is inserted into the channel 76 and through bucket dovetail 28 until it contacts downstream side slot wall 72. Locking pin 23 is then secured within channel 76 by peaning channel opening 78.

Figure 5:
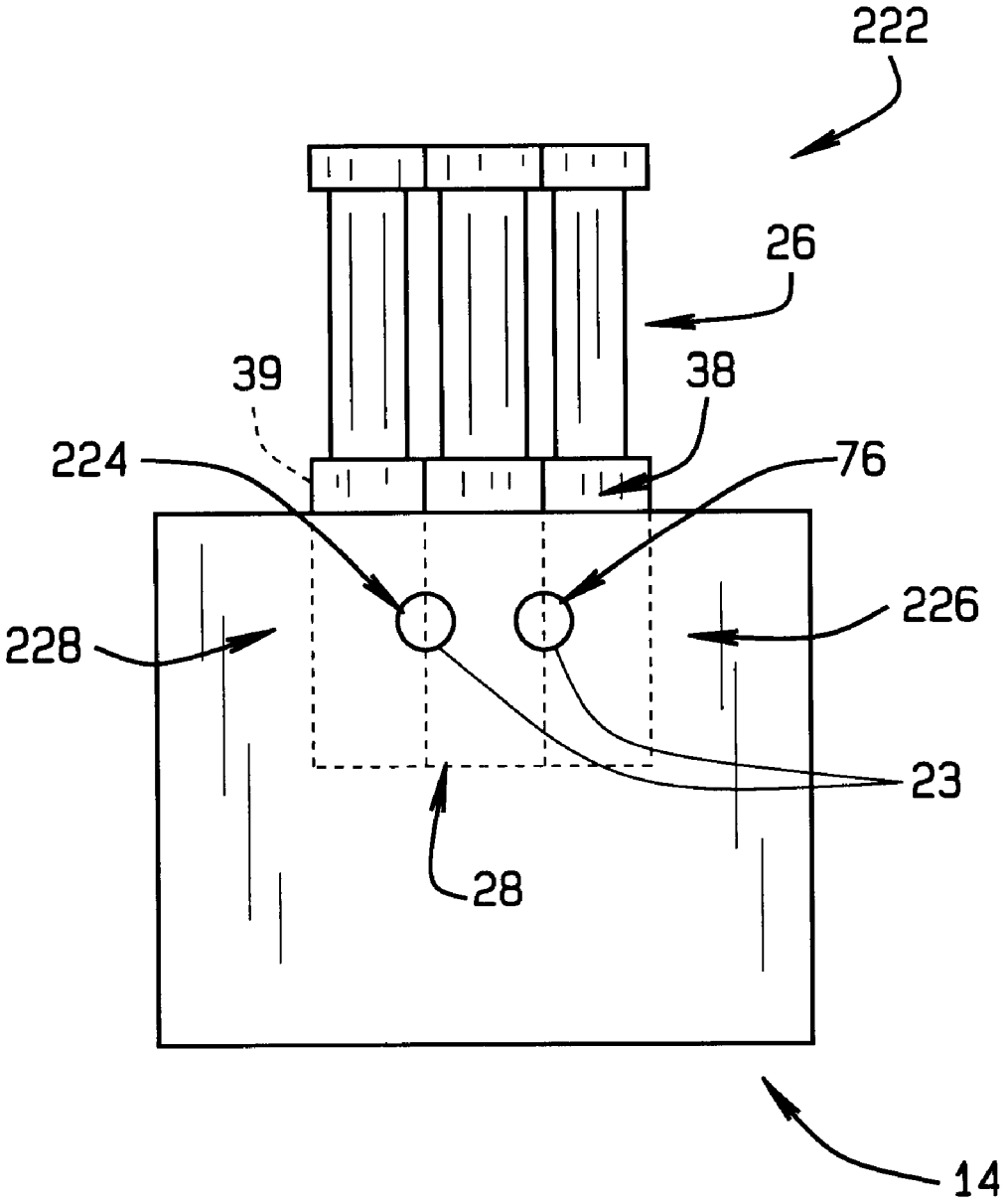
FIG. 5 is a front view of an alternative embodiment of a closure bucket that may be used with the rotor assembly shown in FIG. 1.

FIG. 5 is a front view of an alternative embodiment of a closure bucket 222 that may be used with the rotor assembly shown in FIG. 1. Closure bucket 222 is substantially similar to closure bucket 73 (shown in FIGS. 3 and 4) and components in closure bucket 222 that are identical to components of closure bucket 73 are identified in FIG. 5 using the same reference numbers used in FIGS. 3 and 4. Specifically, closure bucket 222 is identical to closure bucket 73 with the exception that closure bucket 222 includes a plurality of channels 76 and 224 that extend from bucket upstream side 38 through a portion of bucket dovetail 28 to bucket downstream side 39.

First channel 76 is formed at the interface of the first axial face 40 of closure bucket 222 and the adjacent bucket dovetail 226. Second channel 224 is formed at the interface of the second axial face 41 of closure bucket 222 and the adjacent bucket dovetail 228. Thus, channels 76 and 224 are partially reamed in dovetail 28 of closure bucket 222 and partially reamed in each adjacent bucket dovetails 226 and 228. When locking pins 23 are inserted into channels 76 and 226, locking pins 23 secure closure bucket 222 to adjacent bucket dovetails 226 and 228. Since closure bucket 222 is secured to bucket dovetails 226 and 228, the centrifugal load induced to closure bucket 222 is carried by the two adjacent bucket dovetails 226 and 228. In one embodiment, locking pin 23 is fabricated from a hardened material.

Each channel 76 and 224 extends generally from bucket upstream side 38, through bucket dovetail 28, to bucket downstream side 39. In another embodiment, each channel 76 and 224 extends from bucket upstream side 38 through bucket dovetail 28 to bucket downstream side 39 obliquely relative to either first and/or second axial face 40 and 41, respectively.

If closure bucket 222 needs to be removed, locking pin 23 has a tapped hole on bucket upstream side 38. A slide hammer screws into the tapped hole in bucket upstream side 38 of locking pin 23 and the slide hammer pulls the locking pin 23 out. When locking pin 23 is removed, closure bucket 222 is released from loading slot 68. Upon re-insertion of closure bucket 222 into loading slot 68, the same locking pins 23 may be reinserted into the same channels 76 and 224 such that closure bucket 222 is secured to rotor 12.

The above-described rotor assembly is a cost-effective and time saving device. The rotor assembly includes a re-usable locking pin that facilitates securing a basket assembly to the rotor assembly, thus reducing an amount of time necessary to remove and replace a bucket. Furthermore, the locking pin is more easily removably coupled to the closure bucket than other known locking pins. As a result, the locking pin facilitates extending a useful life of the bucket in a cost-effective and a time-saving manner.

Exemplary embodiments of buckets are described above in detail. The systems are not limited to the specific embodiments described herein, but rather, components of each assembly may be utilized independently and separately from other components described herein. Each bucket component can also be used in combination with other bucket and rotor components.

While the invention has been described in terms of various specific embodiments, those skilled in the art will recognize that the invention can be practiced with modification within the spirit and scope of the claims.

What is claimed is:

1. A method of assembling a turbine, said method comprising:

coupling at least one bucket including an upstream side, a downstream side, an airfoil extending therebetween and a dovetail extending radially inwardly from the airfoil to a rotor wheel wherein the bucket dovetail includes substantially planar sidewalls; and fixedly securing the at least one bucket to the rotor wheel with a locking pin that extends from the bucket upstream side through the bucket dovetail to the bucket downstream side.

2. A method in accordance with claim 1 further comprising forming a channel to extend from the upstream side through the bucket dovetail to the downstream side of the bucket.

3. A method in accordance with claim 2 wherein fixedly securing the at least one bucket to the rotor wheel comprises inserting a locking pin through the channel.

4. A method in accordance with claim 3 further comprising forming a plurality of channels that each extend from the bucket upstream side through the bucket dovetail to the bucket downstream.

5. A method in accordance with claim 1 wherein fixedly securing the at least one bucket further comprises fixedly securing the at least one bucket to the rotor wheel using at least one locking pin that has a substantially linear cross-sectional profile.

6. A rotor assembly for a turbine comprising:

a plurality of buckets secured to a rotor wheel, each said plurality of bucket comprising an upstream side, a downstream side, an airfoil, and a dovetail including substantially planar sidewalls, each said airfoil extending radially from each said dovetail, said plurality of buckets comprising at least a first bucket, and at least a second bucket; and at least one locking pin for securing at least one bucket to said rotor wheel, such that said locking pin extends from said bucket upstream side through said bucket dovetail to said bucket downstream side.

7. A rotor assembly in accordance with claim 6 wherein said at least one locking pin comprises a substantially linear cross-sectional profile.

8. A rotor assembly in accordance with claim 7 wherein said second bucket is secured to said rotor wheel by said dovetail.

9. A rotor assembly in accordance with claim 6 wherein said rotor wheel comprises a substantially annular retaining ring for securing said second bucket to said rotor wheel.

10. A rotor assembly in accordance with claim 6 wherein each said dovetail comprises a plurality of dovetail tangs.

11. A rotor assembly in accordance with claim 6 wherein said at least one locking pin extends through a portion of said bucket dovetail and through at least a portion of a circumferentially adjacent bucket dovetail.

12. A rotor assembly in accordance with claim 6 wherein at least one bucket further comprises a pressure side locking pin and a suction side locking pin.

13. A turbine comprising:

at least one rotor assembly comprising at least one rotor wheel;

a plurality of buckets secured to said rotor wheel, each said plurality of bucket comprising an upstream side, a downstream side, an airfoil and a dovetail including substantially planar sidewalls, each said airfoil extending radially from said dovetail, said plurality of buckets comprising at least one first bucket and at least one second bucket; and at least one locking pin for securing said at least one first bucket to said rotor wheel, such that said locking pin extends from said bucket upstream side through said bucket dovetail to said bucket downstream side.

14. A turbine in accordance with claim 13 wherein said at least one second bucket is secured to a hook of said rotor wheel by said bucket dovetail.

15. A turbine in accordance with claim 14 wherein said rotor wheel hook comprises a substantially annular retaining ring.

16. A turbine in accordance with claim 14 wherein said at least one locking pin extends through a portion of said bucket dovetail and through at least a portion of a circumferentially adjacent bucket dovetail.

17. A turbine in accordance with claim 14 wherein each said bucket dovetail comprises dovetail tangs.

18. A turbine in accordance with claim 14 wherein said at least one locking pin further comprises a pressure side locking pin and a suction side locking pin.

19. A turbine in accordance with claim 13 wherein said at least one locking pin comprises a substantially linear cross-sectional profile.

* * * * *